US011314207B2

(12) United States Patent
Silvant

(10) Patent No.: US 11,314,207 B2
(45) Date of Patent: Apr. 26, 2022

(54) ANNULAR RETAINING RING FOR A ROTATING BEZEL SYSTEM

(71) Applicant: Omega SA, Biel/Bienne (CH)

(72) Inventor: Olivier Silvant, Macolin (CH)

(73) Assignee: Omega SA, Biel/Bienne (CH)

( * ) Notice: Subject to any disclaimer, the term of this patent is extended or adjusted under 35 U.S.C. 154(b) by 531 days.

(21) Appl. No.: 16/356,288

(22) Filed: Mar. 18, 2019

(65) Prior Publication Data

US 2019/0294115 A1 Sep. 26, 2019

(30) Foreign Application Priority Data

Mar. 20, 2018 (EP) ..... 18162850

(51) Int. Cl.
*G04B 19/28* (2006.01)

(52) U.S. Cl.
CPC ..... *G04B 19/283* (2013.01)

(58) Field of Classification Search
CPC .... G04B 19/283; G04B 19/286; G04B 37/00; G04B 37/08; G04B 37/0008; G04B 19/18; G04B 19/22; G04B 19/223; G04B 19/225
USPC ..... 368/21–22, 294–295
See application file for complete search history.

(56) References Cited

U.S. PATENT DOCUMENTS 5,541,895 A * 7/1996 Nussbaum ..... G04B 19/283 368/295
2003/0123332 A1* 7/2003 Hiranuma ..... G04B 19/286 368/295
2004/0141424 A1* 7/2004 Hartmann ..... G04B 19/283 368/295
2013/0201804 A1 8/2013 Bertrand et al.
2015/0185702 A1 7/2015 Silvant

FOREIGN PATENT DOCUMENTS

| | | | |
|---|---|---|---|
| CN | 103246197 | A | 8/2013 |
| CN | 104412176 | A | 3/2015 |
| DE | 10 2014 115 811 | B3 | 6/2015 |
| EP | 0 436 468 | A1 | 7/1991 |
| EP | 0 770 937 | A1 | 5/1997 |
| EP | 2 624 076 | A1 | 8/2013 |
| EP | 2 672 333 | A1 | 12/2013 |
| JP | 7-5275 | A | 1/1995 |
| JP | 2013-160764 | A | 8/2013 |
| JP | 2015-518967 | A | 7/2015 |

(Continued)

OTHER PUBLICATIONS

Japanese Office Action dated Nov. 17, 2020 in Japanese Patent Application No. 2019-044507 (with English translation), 4 pages.

(Continued)

*Primary Examiner* — Edwin A. Leon
(74) *Attorney, Agent, or Firm* — Oblon, McClelland, Maier & Neustadt, L.L.P.

(57) ABSTRACT

An annular retaining ring for a rotating bezel system, intended to cooperate with an external cylindrical surface of a case middle part of a watch case to allow rotation of the rotating bezel on the case middle, the annular ring including a device for guiding rotation of the rotating bezel around the case middle; wherein the annular ring further includes a device configured to brake rotation of the rotating bezel around the case middle and to dampen sound.

19 Claims, 3 Drawing Sheets

(56) References Cited

FOREIGN PATENT DOCUMENTS

WO WO 2007/071760 A1 6/2007

OTHER PUBLICATIONS

Korean Notice of Final Rejection dated Dec. 29, 2020 in Korean Patent Application No. 10-2019-0029951 (with English translation), 8 pages.
Combined Chinese Office Action and Search Report dated Jul. 29, 2020 in Chinese Patent Application No. 201910209204.9 (with English translation and Translation of Category of Cited Documents), 17 pages.
Notice of Grounds for Rejection dated Jul. 15, 2020 in Korean Patent Application No. 10-2019-0029951 (with English translation), 12 pages.
European Search Report dated Nov. 7, 2018 in European Application 18162850.4, filed on Mar. 20, 2018 (with English Translation of Categories of Cited Documents & Written Opinion).

* cited by examiner

ANNULAR RETAINING RING FOR A ROTATING BEZEL SYSTEM

CROSS-REFERENCE TO RELATED APPLICATION

This application claims priority to European Patent Application No. 18162850.4 filed on Mar. 20, 2018, the entire disclosure of which is hereby incorporated herein by reference.

FIELD OF THE INVENTION

The invention concerns an annular retaining ring for a rotating bezel system.

The invention also concerns an annular rotating bezel system comprising the retaining ring.

The invention also concerns a watch case comprising a case middle part and the annular rotating bezel system rotatably mounted on the case middle.

The invention also concerns a watch including the watch case. The watch is, for example, a diver's watch, although this is not limiting in the context of the present invention.

BACKGROUND OF THE INVENTION

Known annular rotating bezel systems are provided with an annular retaining ring for the system, intended to cooperate with an external cylindrical surface of a watch case middle to allow rotation of the rotating bezel on the case middle. Such an annular retaining ring for a rotating bezel system is disclosed, for example, in European Patent Application No 2672333A1. The annular ring is a flat ring provided with an inner rim comprising a peripheral protrusion. The peripheral protrusion cooperates with an annular bulge of an external wall of the case middle to hold the rotating bezel system vertically on the case middle and serves as means for guiding rotation of the rotating bezel around the case middle. However, in such a rotating bezel system, the annular ring does not ensure good braking torque between the rotating bezel and the external wall of the case middle.

Moreover, when the rotating bezel rotates around the case middle, the meshing of various elements of the system produces an unpleasant noise for the user, detrimental to the qualitative perception that the user may have as to the quality of the watch,

SUMMARY OF THE INVENTION

It is therefore an object of the invention to provide an annular retaining ring for a rotating bezel which ensures good braking torque between the rotating bezel and the external wall of the case middle and controls the noise produced during rotation of the bezel, while maintaining good rotational guidance of the rotating bezel around the case middle.

To this end, the invention concerns an annular retaining ring for a rotating bezel system, which includes the features mentioned in the independent claim 1.

Specific embodiments of the ring are defined in the dependent claims 2 to 13.

A first advantage of the present invention is that it ensures good braking torque between the rotating bezel and the external wall of the case middle. Indeed, owing to the presence of means configured to brake rotation of the rotating bezel around the case middle and to dampen sound, any play inside the rotating bezel system is smoothed out, so that the user of the bezel does not feel it. The rotational torque of the bezel is also controlled, making it softer and the bezel more pleasant to handle. Moreover, the noise produced by rotation of the bezel is dampened and gives the user the impression that the bezel system, and more generally the watch fitted with this system, is of good quality.

Further, the annular ring makes it possible to hold the spring means and the toothed ring inside the rotating bezel, thus facilitating mounting of the rotating bezel on the case middle.

According to a first embodiment of the invention, the annular ring includes, on an edge, an alternation of tongues of a first group of tongues, and tongues of a second group of tongues, the tongues of the first group and the tongues of the second group having different dimensions in the radial direction, the tongues of either the first or of the second group of tongues forming said rotational guide means, the tongues of the other of the first and second group of tongues forming said braking and sound dampening means. One advantage of this first embodiment is that it limits dirt entering the rotating bezel system, owing to the presence of the various tongues which block such dirt.

Advantageously, according to this first embodiment, the tongues of the first group have dimensions in the radial direction that are smaller than those of the tongues of the second group, the tongues of the first group forming said rotation guide means, the tongues of the second group being formed of more flexible segments than the tongues of the first group, said segments being able to bend axially and forming said braking and sound dampening means. Owing to the axial flexibility of the tongues of the second group, said tongues can brake rotation of rotating bezel about case middle by friction against the external cylindrical surface, and also dampen the sound produced.

Also, advantageously, according to this first embodiment, the tongues of the first and second groups are separated from each other by hollows. This improves, in particular, the flexibility of the tongues of the second group of tongues.

Also, advantageously, according to this first embodiment, the first and second tongue groups each include six tongues, the tongues of the first and second groups being distributed over 360°, the tongues of a same tongue group being spaced apart by 60° from each other. This further improves braking and sound dampening, especially by further reducing any play inside the system and by making the rotational torque even softer.

According to a second embodiment of the invention, the annular ring includes, on an inner or outer edge, a set of bosses, said bosses forming said braking and sound dampening means. One advantage of this second embodiment is that the bosses act radially in a plane in which the ring extends, and not perpendicularly to this plane like the tongues of the first embodiment. Owing to the radial flexibility of the bosses, said bosses can brake rotation of the rotating bezel about the case middle by friction against the case middle or the bezel, and also dampen the sound produced. In a first variant of this second embodiment, the bosses are arranged on an inner edge of the ring to cooperate with an external cylindrical surface of the case middle, the annular ring being intended to be joined to the rotating bezel. In a second variant of this second embodiment, the bosses are arranged on an outer edge of the ring to cooperate with an inner surface of the rotating bezel, the annular ring being intended to be joined to the case middle.

Advantageously, according to this second embodiment, the annular ring includes a set of oblong slots, each oblong slot being arranged in the thickness of the annular ring facing one of said bosses, thickness being measured in an axial direction perpendicular to a plane in which the ring extends. This allows each boss to be given radial flexibility in the plane in which the ring extends.

Also, advantageously, according to this second embodiment, the annular ring has six bosses distributed over 360°, the bosses being spaced apart from each other by 60°. This further improves braking and sound dampening, especially by further reducing any play inside the system and by making the rotational torque even softer.

Advantageously, the annular ring is formed of a single piece of material consisting of a plastic material, especially PTFE, ethylene tetrafluoroethylene (Tefzel®), and polyoxymethylene (Delrin®), where necessary coated with a layer intended to improve the friction coefficient. This material has the advantage of offering a good compromise between flexibility and rigidity, allowing the tongues of the first tongue group and the tongues of the second tongue group to have the desired elastic and mechanical properties.

To this end, the invention also concerns an annular rotating bezel system comprising the annular retaining ring described above, and which includes the features mentioned in the dependent claim 14.

To this end, the invention also concerns a watch case including the annular rotating bezel system described above, and which includes the features mentioned in the dependent claim 15.

Specific embodiments of the watch case are defined in the dependent claims 16 and 17.

To this end, the invention also concerns a watch including the watch case described above, and which includes the features mentioned in the dependent claim 18.

BRIEF DESCRIPTION OF THE DRAWINGS

The objects, advantages and features of the annular retaining ring for a rotating bezel system according to the invention will appear more clearly in the following description, based on at least one non-limiting embodiment illustrated by the drawings, in which.

DETAILED DESCRIPTION OF THE INVENTION

Figure 1:
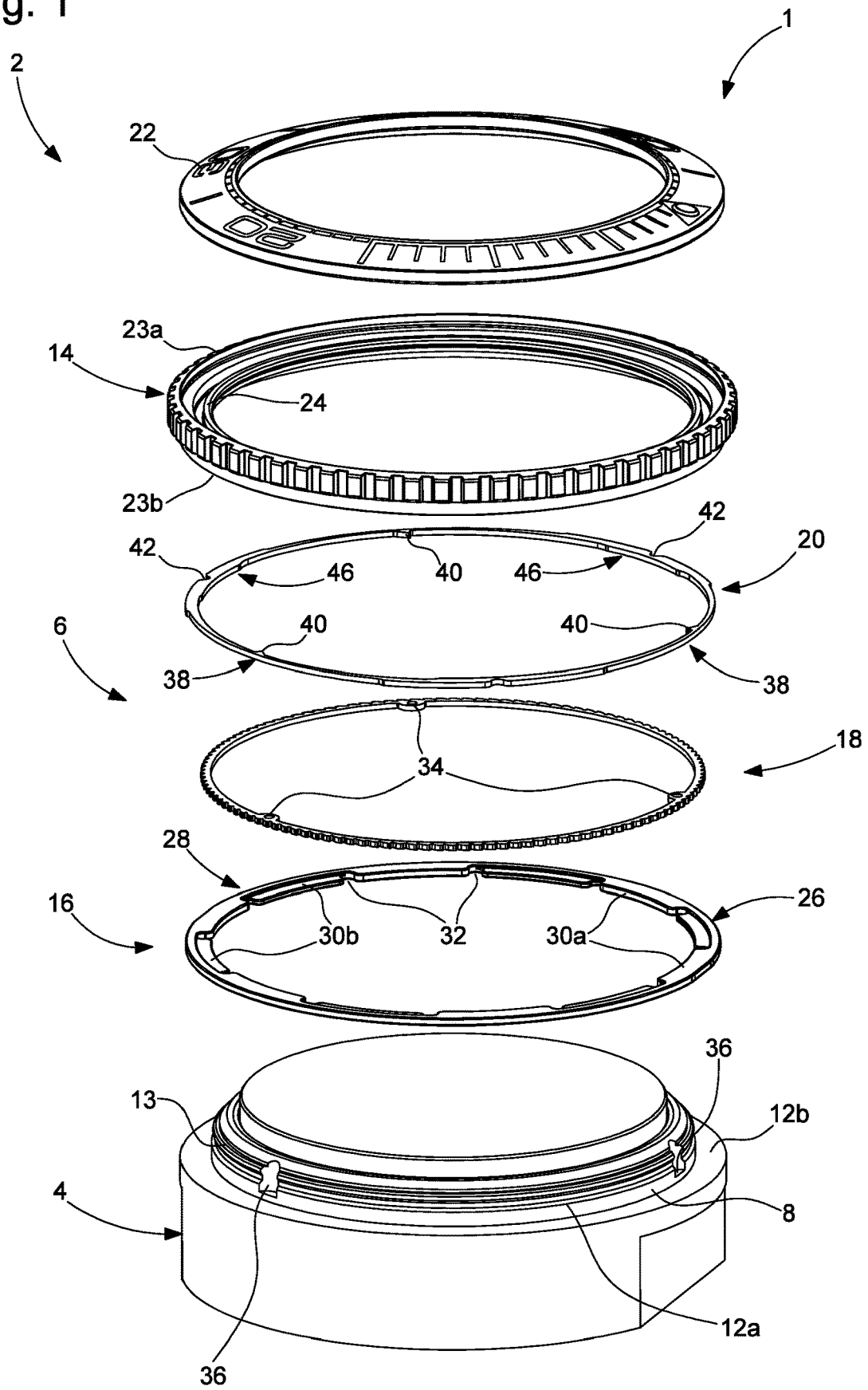
FIG. 1 is an exploded perspective view of an annular rotating bezel system comprising an annular retaining ring according to a first embodiment of the invention.
Figure 2:
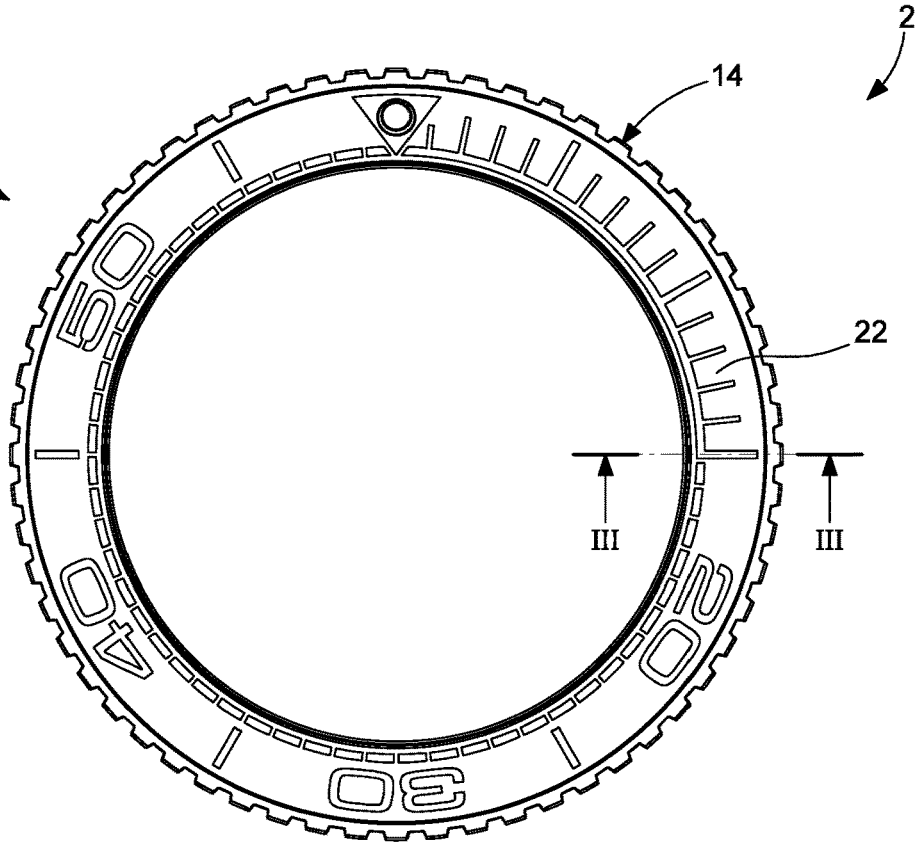
FIG. 2 is a top view of the annular rotating bezel system of FIG. 1, once assembled.
Figure 3:
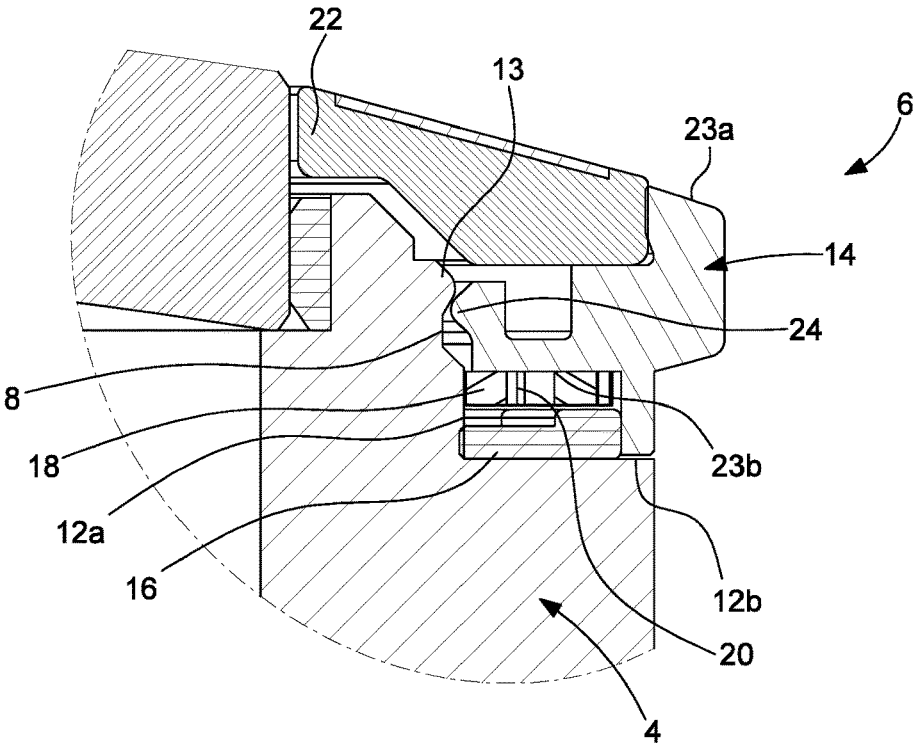
FIG. 3 is a sectional view of the system of FIG. 2, taken along a sectional plane III-III.

FIG. 1 represents a watch 1 provided with a watch case 2. Watch case 2 typically includes a case middle 4. Watch case 2 also includes an annular rotating bezel system 6 and a timepiece movement that extends in a plane, the timepiece movement being omitted from the Figures for reasons of clarity. The annular rotating bezel system 6 is rotatably mounted on case middle 4. Preferably, as illustrated in FIGS. 1 to 3, annular rotating bezel system 6 consists of an independent module. Annular rotating bezel system 6 is, for example, clipped onto case middle 4, as will be detailed hereinafter.

As illustrated in FIG. 1, case middle 4 is of annular shape. Case middle 4 includes an external cylindrical surface 8. As seen in FIG. 3, external cylindrical surface 8 is provided with a peripheral shoulder defined by a lateral wall 12*a* and a base 12*b*. This peripheral shoulder serves as a housing for rotating bezel system 6. Lateral wall 12*a* includes an annular protrusion or bulge 13 extending over the entire perimeter of lateral wall 12*a* and allowing rotating bezel system 6 to be secured by clipping onto case middle 4. Annular rotating bezel system 6 rests on base 12*b*. Rotating bezel system 6 is thus mounted on case middle 4, from the top of the latter, thereby blocking system 6 in an axial direction perpendicular to the plane of the timepiece movement, while allowing rotation of the bezel around case middle 4. In the watch case 2 taken as an example in FIGS. 1 to 3, the configuration of the watch case is substantially circular. However, the invention is not limited to this watch case configuration, or to the other arrangements described above for case middle 4. The case middle may be made of metal, typically steel, titanium, gold, platinum or ceramic, typically made from alumina, zirconia or silicon nitride.

Annular rotating bezel system 6 includes a rotating bezel 14, an annular retaining ring 16, a toothed ring 18 and spring means 20. Preferably, system 6 further includes a decorative ring 22 press fitted onto rotating bezel 14. Decorative ring 22 bears, for example, graduations, typically diving graduations in the case of a diver's watch 1. Decorative ring 22 is for example made of ceramic.

Rotating bezel 14 is of annular shape and includes an upper surface 23*a* visible to the user and a lower surface 23*b*. As illustrated in FIGS. 1 and 3, rotating bezel 14 is, for example, provided with an annular rim 24 on an inner edge. Annular rim 24 engages by clipping together with protrusion 13 of case middle 4, and forms therewith a free hooking system. Rotating bezel 14 is, for example, made of metal but could be made of any other material, for example, of ceramic.

Annular ring 16 holds toothed ring 18 and spring means 20 in bezel 14, in an axial direction perpendicular to the plane of the timepiece movement. This facilitates the mounting of rotating bezel 14 on case middle 4. Preferably, and as seen in FIG. 3, annular ring 16 is pressed into rotating bezel 14, securing it thereto. In a variant not represented in the Figures, annular ring 16 is secured to case middle 4.

Annular ring 16 rests on base 12*b* of case middle 4, and thus surrounds external cylindrical surface 8 of case middle 4. Annular ring 16 is configured to cooperate with external cylindrical surface 8 to allow rotation of rotating bezel 14 on case middle 4.

Figure 4:
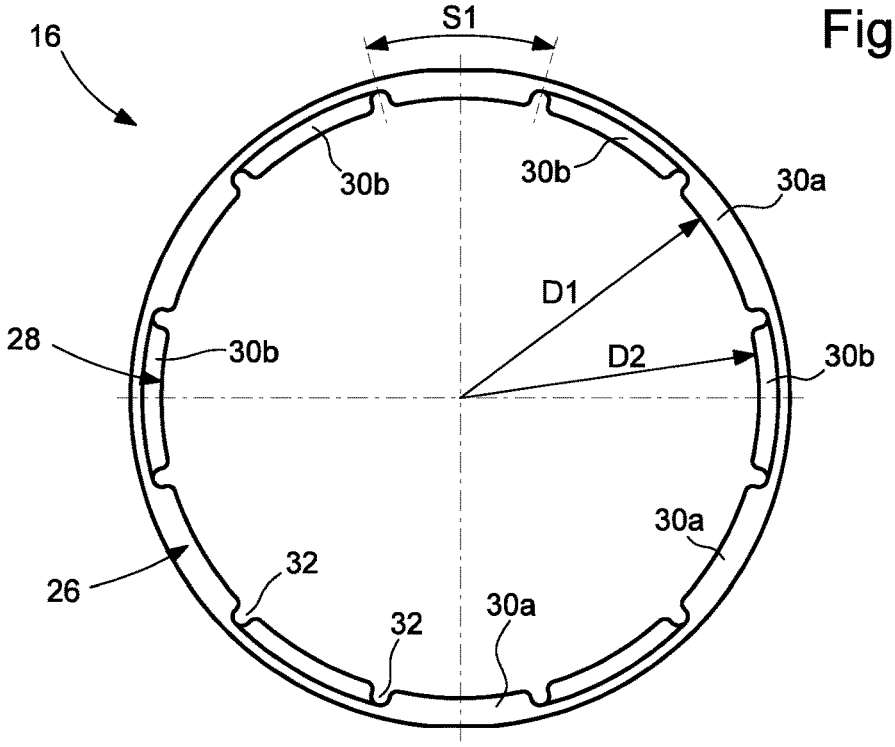
FIG. 4 is a top view of the annular ring of FIG. 1.
Figure 5A:
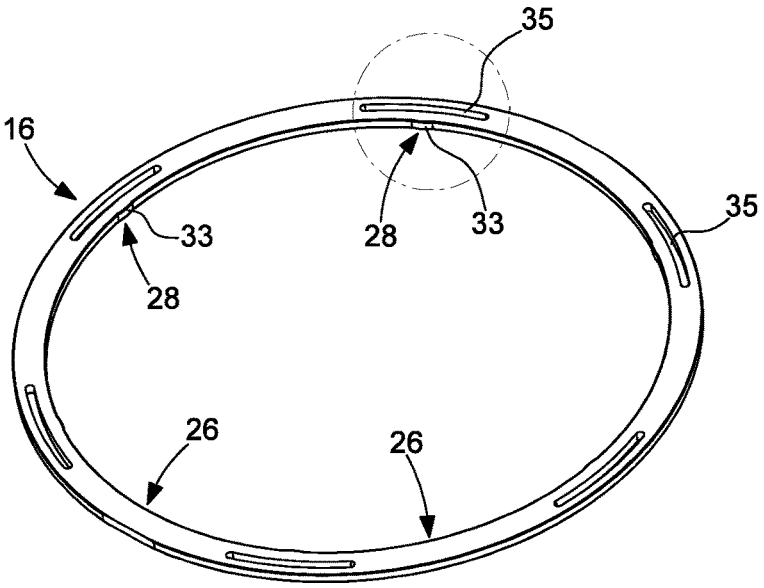
FIG. 5*a* is a perspective view of an annular ring according to a second embodiment of the invention.

As illustrated in FIGS. 1, 4 and 5*a*, annular ring 16 according to the invention includes means 26 for guiding rotating bezel 14 in rotation around case middle 4 and means 28 configured to brake rotation of rotating bezel 14 around case middle 4 and to dampen sound. Annular ring 16 is, for example, formed of a single piece of material consisting of a plastic material, especially PTFE, ethylene tetrafluoroethylene (Tefzel®), and polyoxymethylene (Delrin®), where necessary coated with a layer intended to improve the friction coefficient. Annular ring 16 is, for example, of generally rectangular cross-section.

In a first embodiment represented in FIGS. 1 and 4, annular ring 16 includes, on an inner edge, an alternation of tongues 30*a* of a first group of tongues, and tongues 30*b* of a second group of tongues. Tongues 30*a* of the first group and tongues 30*b* of the second group are in contact with external cylindrical surface 8 of case middle 4. Such tongues 30*a*, 30*b* limit the passage of dirt into rotating bezel system 6. In the variant not represented in the Figures, wherein annular ring 16 is integral with case middle 4, tongues 30*a* of the first group and tongues 30*b* of the second group are arranged on an external edge of annular ring 16 and are in contact with an inner surface of rotating bezel 14.

In the example embodiment of FIGS. 1 and 4, the first and second groups of tongues each include six tongues 30*a*, 30*b*, distributed over the inner edge of ring 16 over 360°. The tongues of the same group of tongues are thus spaced apart by 60° from each other, tongues 30*a*, 30*b* of the first and second groups of tongues being alternated.

Tongues 30*a* of the first group and tongues 30*b* of the second group have different dimensions in the radial direction. In the example embodiment of FIGS. 1 and 4, tongues 30*a* of the first group of tongues have smaller dimensions in the radial direction than those of tongues 30*b* of the second group of tongues, and form rotational guide means 26. Thus, as represented in FIG. 4, the radial distance D1 separating tongues 30*a* of the first tongue group from the centre of ring 16 is greater than the radial distance D2 separating tongues 30*b* of the second tongue group from the centre of ring 16.

Tongues 30*b* of the second group of tongues form braking and sound dampening means 28. More precisely, tongues 30*b* of the second group of tongues are formed of more flexible segments than tongues 30*a* of the first group. These segments are able to bend in an axial direction perpendicular to the plane of the timepiece movement. To achieve this, a specific example embodiment represented in FIGS. 1 and 4 consists in that tongues 30*a* of the first group and tongues 30*b* of the second group have different thicknesses, thickness being measured in the axial direction perpendicular to the plane of the timepiece movement. Typically, tongues 30*b* of the second group have a smaller thickness than that of tongues 30*a* of the first group, thereby giving them greater flexibility. Owing to the axial flexibility of tongues 30*b* of the second group, said tongues can brake rotation of rotating bezel 14 about case middle 4 by friction against external cylindrical surface 8, and also dampen the sound produced.

Preferably, tongues 30*a*, 30*b* of the first and second groups are separated from each other by hollows 32. This improves, in particular, the flexibility of tongues 30*b* of the second group of tongues.

Preferably too, as seen in FIG. 4, tongues 30*a*, 30*b* of the first and second tongue groups extend angularly over a substantially equal angular sector S1.

Figure 5B:
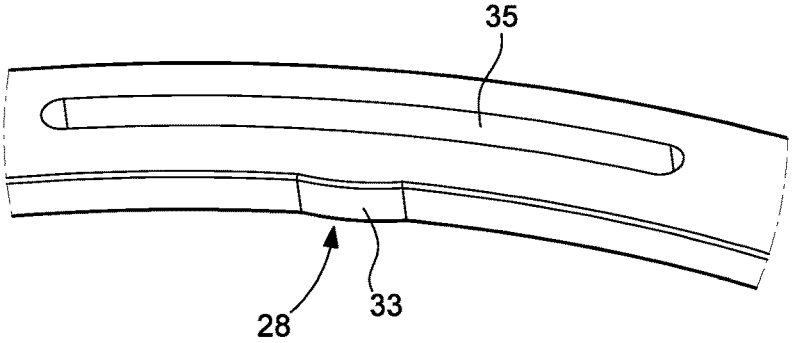
FIG. 5*b* is an enlarged view of a detail of the annular ring of FIG. 5*a*.

In a second embodiment represented in FIGS. 5*a* and 5*b*, annular ring 16 no longer has tongues but, on an inner edge, has a set of bosses 33. Bosses 33 are in contact with external cylindrical surface 8 of case middle 4 and form braking and sound dampening means 28. These bosses 33 act radially in a plane in which ring 16 extends, and not perpendicularly to this plane like tongues 30*a*, 30*b* of the first embodiment. In the variant not represented in the Figures, wherein annular ring 16 is integral with case middle 4, bosses 33 are arranged on an external edge of annular ring 16 and are in contact with an inner surface of rotating bezel 14. In the example embodiment illustrated in FIGS. 5*a* and 5*b*, the rotation guide means 26 consist of the rest of the inner edge of ring 16, between bosses 33.

In the example embodiment of FIGS. 5*a* and 5*b*, ring 16 has six bosses 33, distributed over the inner edge of ring 16 over 360°. Bosses 33 are thus spaced apart from each other by 60°.

In order to give bosses 33 radial flexibility in the plane in which ring 16 extends, ring 16 preferably includes a set of oblong slots 35. As illustrated in FIGS. 5*a* and 5*b*, each oblong slot 35 is arranged in the thickness of annular ring 16 facing one of bosses 33. In the example embodiment of FIGS. 5*a* and 5*b*, ring 16 thus has six oblong slots 35, distributed over 360°. Oblong slots 35 are thus spaced apart from each other by 60°.

Owing to the radial flexibility of bosses 33 in the plane in which ring 16 extends, said bosses can brake rotation of rotating bezel 14 about case middle 4 by friction against external cylindrical surface 8, and also dampen the sound produced.

Braking the rotation of bezel 14 via means 28 has the advantage of smoothing the different plays inside the system so that the user of the bezel does not feel them, and of controlling the rotational torque of the bezel by softening it. Further, braking and sound dampening means 28 reduce the noise produced by rotation of the bezel and thus improve user experience. Toothed ring 18 includes several teeth, for example 120 teeth, also distributed over 360° on its external edge. Preferably, toothed ring 18 also has, on its inner edge, at least one lug 34 received in a hollow 36 provided in external cylindrical surface 8 of case middle 4. In the example embodiment illustrated in FIG. 1, toothed ring 18 includes three lugs 34 distributed over 360° and spaced apart from each other by 120°. External cylindrical surface 8 of case middle 4 has three corresponding hollows 36. This system of lugs 34/hollows 36 allows easy angular joining of toothed ring 18 to case middle 4, while facilitating the positioning of toothed ring 18 on case middle 4. This system also allows rotating bezel system 6 to be guided for mounting on case middle 4. Thus, pressing from the top of system 6 causes lugs 34 to engage in hollows 36, locking the elements inside system 6 and clipping system 6 onto case middle 4.

Toothed ring 18 is formed of a single piece of material. Toothed ring 18 is formed, for example, of a metal alloy, especially a cobalt based alloy (40% Co, 20% Cr, 16% Ni and 7% Mo) commercially known as phynox or steel, typically a stainless steel such as 316L steel. In a variant, toothed ring 18 may be formed of a thermoplastic material, particularly a thermostable, semi-crystalline thermoplastic material, such as, for example, polyarylamide (Ixef®), polyetheretherketone (PEEK) or of a ceramic material (zirconia or alumina).

Spring means 20 engage elastically with toothed ring 18. In the example embodiment illustrated in FIGS. 1 to 3, spring means 20 are formed of a spring ring. As visible in FIG. 3, toothed ring 18 is arranged to be inserted into spring ring 20, i.e. toothed ring 18 is sized to be able to be placed inside spring ring 20. Toothed ring 18 and spring ring 20 are concentric and coplanar and are held between lower face 23*b* of bezel 14 and an upper face of retaining ring 16.

Spring ring 20 comprises at least one thinned portion 38 having at least one tooth 40 elastically and radially in mesh with toothed ring 18. In the example embodiment illustrated in FIG. 1, spring ring 20 comprises three thinned portions 38 distributed over 360°, each thinned portion 38 having one tooth 40 arranged in a median part of thinned portion 38. The three thinned portions 38 are spaced apart by 120° from each other. Spring ring 20 extends in a plane in which it is capable of deforming elastically along one radius. Thinned portions 38 are arranged to increase the flexibility of spring ring 20 in its plane. This configuration means that, when toothed ring 18 is inserted inside spring ring 20, teeth 40 cooperate with the teeth of toothed ring 18. In this configuration, each tooth 40 is in contact with toothed ring 18 so that there is a rest position in which each tooth 40 lies in a hollow between two teeth of toothed ring 18. When the user takes hold of bezel 14 and rotates it, the flexibility of spring ring 20 provided by thinned portions 38, causes spring ring 20 to deform elastically in its plane, allowing teeth 40 to be released from the hollows of toothed ring 18 and to re-engage in an adjacent tooth of toothed ring 18. Bezel 14 then actually rotates by a corresponding angular sector into a new position.

Preferably, as illustrated in FIG. 1, thinned portions 38 are thinned radially.

Again preferably, on its outer edge, spring ring 20 has at least one hollow 42 in which a lug of bezel 14 is engaged. In the example embodiment illustrated in FIG. 1, spring ring 20 includes three hollows 42 distributed over 360° and spaced apart from each other by 120° and rotating bezel 14 has three corresponding lugs on an inner lateral face. Hollows 42 are arranged in portions 46 of spring ring 20 that are thicker than thinned portions 38 in median parts of these portions 46. Thus, teeth 40 and hollows 42 are alternated on spring ring 20, regularly distributed over 360°. This system of lugs/hollows 42 makes it easy to rotatably connect spring ring 20 to rotating bezel 14, while facilitating the positioning of spring ring 20 in bezel 14.

Spring ring 20 is formed of a single piece of material. Spring ring 20 is, for example, formed of a metal alloy, having good spring properties, i.e. which deforms elastically easily while being able to deform significantly without undergoing Plastic deformation, especially Phynox® or amorphous metal alloys. Of course, spring ring 20 can also, in a variant, be made from a synthetic material.

The preceding description of the annular rotating bezel system of the invention was given with reference to a toothed ring angularly integral with the case middle, and to spring means angularly integral with the rotating bezel. However, those skilled in the art will understand that the reverse configuration is possible without departing from the scope of the present invention, i.e. the toothed ring may be angularly integral with the rotating bezel, and the spring means angularly integral with the case middle.

The invention claimed is:

1. An annular retaining ring for a rotating bezel system, configured to cooperate with an external cylindrical surface of a case middle of a watch case to allow rotation of a rotating bezel on the case middle, the annular retaining ring comprising:

means for guiding rotation of the rotating bezel around the case middle; and means configured to brake rotation of the rotating bezel around the case middle and to dampen sound, wherein the annular retaining ring comprises, on one edge, an alternation of tongues of a first group of tongues and tongues of a second group of tongues, the tongues of the first group and the tongues of the second group having different dimensions in a radial direction, the tongues of either the first or second group of tongues forming said rotation guide means, the tongues of the other of the first and second groups of tongues forming said braking and sound dampening means.

2. The annular retaining ring according to claim 1, wherein the tongues of the first group have dimensions in the radial direction that are smaller than those of the tongues of the second group, the tongues of the first group forming said rotation guide means, the tongues of the second group being formed of more flexible segments than the tongues of the first group, said segments being able to bend axially and forming said braking and sound dampening means.

3. The annular retaining ring according to claim 1, wherein the tongues of the first group and the tongues of the second group have different thicknesses, such that the tongues of either the first or the second group of tongues are more flexible than the tongues of the other of the first and second groups of tongues, thickness being measured in an axial direction perpendicular to a plane wherein the bezel extends.

4. The annular retaining ring according to claim 1, wherein the tongues of the first and second groups are separated from each other by hollows.

5. The annular retaining ring according to claim 1, wherein the first and second tongue groups each include six tongues, the tongues of the first and second groups being distributed over 360°, the tongues of a same tongue group being spaced apart from each other by 60°.

6. The annular retaining ring according to claim 1, wherein the tongues of the first and second groups extend angularly over a substantially equal angular sector.

7. The annular retaining ring according to claim 1, wherein the tongues of the first group and the tongues of the second group are arranged on an inner edge of the annular retaining ring; the annular retaining ring being intended to be joined to the rotating bezel.

8. The annular retaining ring according to claim 1, wherein the tongues of the first group and the tongues of the second group are arranged on an outer edge of the annular retaining ring; the annular retaining ring being intended to be joined to the case middle.

9. The annular retaining ring according to claim 1, wherein the annular retaining ring is formed of a single piece of material formed of a plastic material.

10. The annular retaining ring according to claim 9, wherein the plastic material is PTFE, ethylene tetrafluoroethylene, or polyoxymethylene.

11. A watch case comprising:

a case middle and an annular rotating bezel system provided with an annular rotating bezel rotatably mounted on the case middle, wherein the annular rotating bezel system comprises the annular rotating bezel, an annular retaining ring, a toothed ring and spring means cooperating elastically with the toothed ring, said toothed ring and said spring means being held in an axial direction perpendicular to the plane of the movement in the annular rotating bezel by the annular retaining ring, either the toothed ring or the spring means being arranged to be angularly joined to the annular rotating bezel, and the other being arranged to be angularly joined to the case middle, and wherein the annular retaining ring includes means configured to brake rotation of the annular rotating bezel around the case middle and to dampen sound.

12. The watch case according to claim 11, wherein the annular retaining ring comprises, on an inner or outer edge, a set of bosses, said bosses forming said braking and sound dampening means.

13. The watch case according to claim 12, wherein the annular retaining ring comprises a set of oblong slots, each oblong slot being arranged in a thickness of the annular ring facing one of said bosses so as to allow radial flexibility of the boss in a plane wherein the ring extends, the thickness being measured in an axial direction perpendicular to said plane.

14. The watch case according to claim 12, wherein the annular retaining ring comprises six bosses distributed over 360°, the bosses being spaced apart from each other by 60°.

15. The watch case according to claim 11, wherein the annular retaining ring comprises, on one edge, an alternation of tongues of a first group of tongues and tongues of a second group of tongues, the tongues of the first group and the tongues of the second group having different dimensions in a radial direction, the tongues of either the first or second group of tongues forming said rotation guide means, the tongues of the other of the first and second groups of tongues forming said braking and sound dampening means, and wherein the annular retaining ring is joined to the annular rotating bezel, the tongues of the first group and the tongues of the second group or the bosses being in contact with said external cylindrical surface of the case middle.

16. The watch case according to claim 11, wherein the annular retaining ring comprises, on one edge, an alternation of tongues of a first group of tongues and tongues of a second group of tongues, the tongues of the first group and the tongues of the second group having different dimensions in a radial direction, the tongues of either the first or second group of tongues forming said rotation guide means, the tongues of the other of the first and second groups of tongues forming said braking and sound dampening means, and wherein the annular retaining ring is joined to the case middle, the tongues of the first group and the tongues of the second group being in contact with an internal surface of the case middle.

17. The watch case according to claim 12, wherein the annular retaining ring is joined to the case middle, the bosses being in contact with an internal surface of the case middle.

18. An annular rotating bezel system configured to be rotatably mounted on a case middle part of a watch case inside which is housed a timepiece movement which extends in a plane, comprising:

a rotating bezel, an annular retaining ring, a toothed ring and spring means cooperating elastically with the toothed ring, said toothed ring and said spring means being held in an axial direction perpendicular to the plane of the movement in the bezel by the annular retaining ring, either the toothed ring or the spring means being arranged to be angularly joined to the rotating bezel, and the other being arranged to be angularly joined to the case middle, wherein the annular retaining ring includes means configured to brake rotation of the rotating bezel around the case middle and to dampen sound.

19. An annular retaining ring for a rotating bezel system, configured to cooperate with an external cylindrical surface of a case middle of a watch case to allow rotation of a rotating bezel on the case middle, the annular retaining ring comprising:

means for guiding rotation of the rotating bezel around the case middle; and means configured to brake rotation of the rotating bezel around the case middle and to dampen sound, wherein the annular retaining ring comprises, on one edge, an alternation of tongues of a first group of tongues and tongues of a second group of tongues, the tongues of the first group and the tongues of the second group have different thicknesses, such that the tongues of either the first or the second group of tongues are more flexible than the tongues of the other of the first and second groups of tongues, thickness being measured in an axial direction perpendicular to a plane wherein the bezel extends.

* * * * *